US012768270B2

(12) United States Patent
Braendle et al.

(10) Patent No.: US 12,768,270 B2
(45) Date of Patent: Oct. 20, 2026

(54) DEVICE FOR PROVIDING BRAIDS, SYSTEM COMPRISING THE DEVICE AND METHOD FOR PROVIDING BRAIDS

(71) Applicant: Geobrugg AG, Romanshorn (CH)

(72) Inventors: Rico Braendle, Mörschwil (CH); Gabriel Von Rickenbach, Wangen (CH)

(73) Assignee: Geobrugg, Romanshorn (CH)

( * ) Notice: Subject to any disclaimer, the term of this patent is extended or adjusted under 35 U.S.C. 154(b) by 46 days.

(21) Appl. No.: 18/859,037

(22) PCT Filed: Apr. 21, 2023

(86) PCT No.: PCT/EP2023/060513

§ 371 (c)(1),
(2) Date: Oct. 22, 2024

(87) PCT Pub. No.: WO2023/208782

PCT Pub. Date: Nov. 2, 2023

(65) Prior Publication Data

US 2025/0277448 A1 Sep. 4, 2025

(30) Foreign Application Priority Data

Apr. 28, 2022 (DE) ..... 10 2022 110 418.4

(51) Int. Cl.
*E21D 11/15* (2006.01)
*E21D 11/40* (2006.01)

(52) U.S. Cl.
CPC ..... *E21D 11/406* (2016.01)

(58) Field of Classification Search
CPC ..... E21D 11/152; E21D 11/406
See application file for complete search history.

(56) References Cited

U.S. PATENT DOCUMENTS 2,441,544 A 5/1948 Longfield
3,194,231 A * 7/1965 Caracciolo ..... A61H 23/0218 601/81
4,122,682 A 10/1978 Groetschel
4,196,935 A 4/1980 Dring
(Continued)

FOREIGN PATENT DOCUMENTS

AU 2019200996 B1 5/2020
SU 841974 A1 6/1981
(Continued)

OTHER PUBLICATIONS

Office Action of Sep. 26, 2025 issued in corresponding Australian patent application No. 2023262017.
(Continued)

*Primary Examiner* — Carib A Oquendo
(74) *Attorney, Agent, or Firm* — Posz Law Group, PLC

(57) ABSTRACT

A device for providing nettings by means of a construction machine, in particular in mining and/or tunnel construction, has at least one netting receiving apparatus which is configured to receive and at least partially enclose a netting unit and which has a netting receiving opening and a netting output opening, wherein at least the netting output opening is equipped with at least one inhibiting element which is configured to prevent uncontrolled netting output.

26 Claims, 8 Drawing Sheets

(56) References Cited

U.S. PATENT DOCUMENTS

Figure 1:
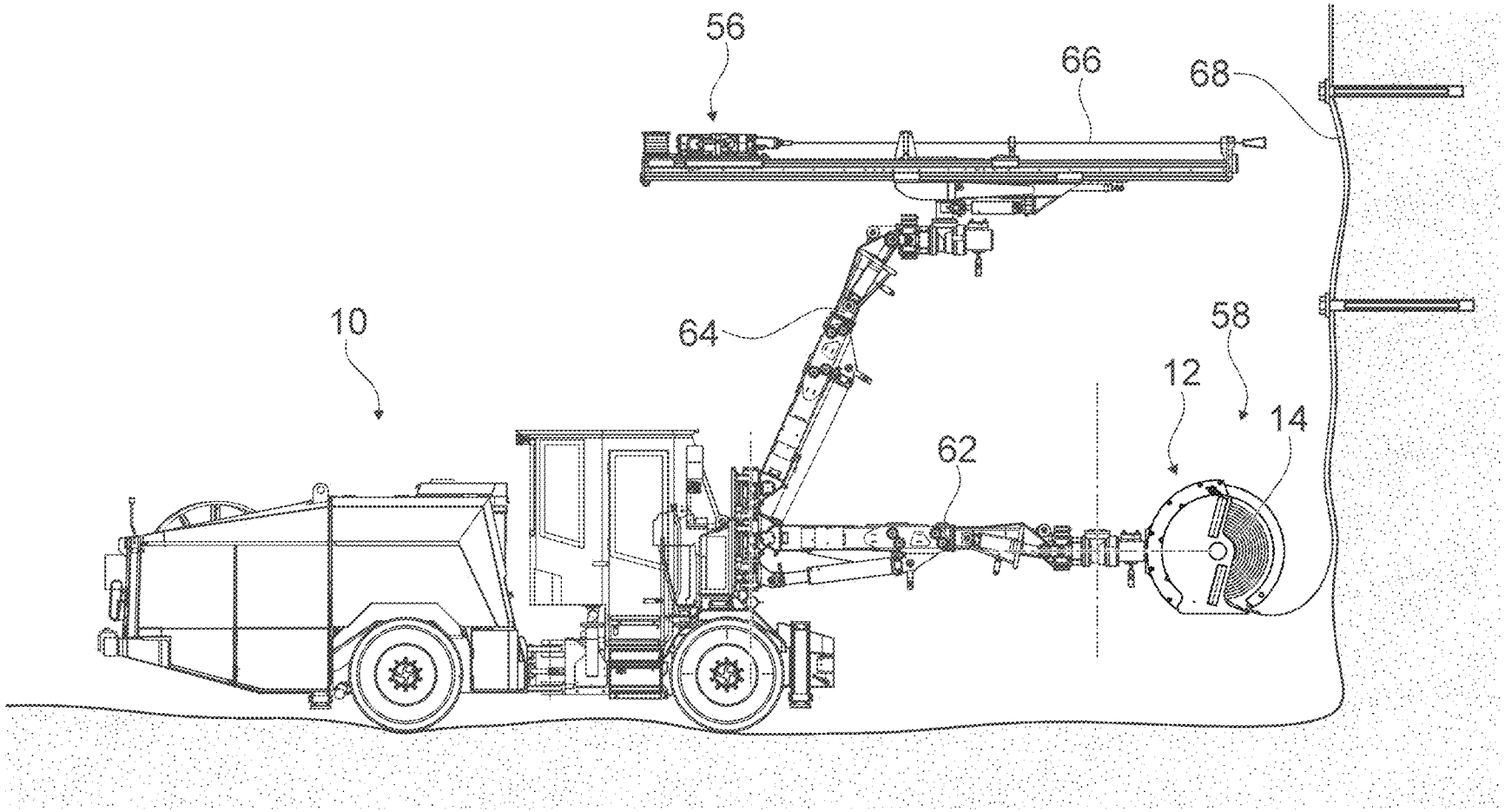

| | | | | |
|---|---|---|---|---|
| 5,816,750 | A * | 10/1998 | Steffenino | E21D 11/006 405/291 |
| 8,137,033 | B1 * | 3/2012 | Hinshaw | E21D 11/40 405/302.3 |
| 10,837,589 | B2 | 11/2020 | Weisenberg et al. | |
| 2011/0094659 | A1 * | 4/2011 | Zivanovic | F16L 55/1655 156/425 |
| 2011/0150575 | A1 * | 6/2011 | Brown | E21D 11/152 405/150.1 |

FOREIGN PATENT DOCUMENTS

| | | | |
|---|---|---|---|
| WO | 2010/015339 | A2 | 2/2010 |
| WO | 2017/207712 | A1 | 12/2017 |
| WO | 2021/008771 | A1 | 1/2021 |

OTHER PUBLICATIONS

German Search Report dated Dec. 15, 2022 issued for the corresponding German Patent Application No. DE 102022110418.4 ( and Partial English translation).

International Preliminary Report on Patentability dated Oct. 29, 2024 and Written Opinion of the International Searching Authority dated Jul. 11, 2023 issued for the corresponding International Application No. PCT/EP2023/060513 (and English translation).

International Search Report dated Jul. 11, 2023 issued for the corresponding International Application No. PCT/EP2023/060513 (and English translation).

Office Action dated Nov. 14, 2023 issued for the corresponding Chilean Patent Application No. 202201824 (and English translation).

Office Action dated Aug. 5, 2024 issued for the corresponding Chilean Patent Application No. 202201824 (and English translation).

Office Action dated Jun. 3, 2025 received in corresponding Russian patent application No. 2024134851.

Office Action mailed on Apr. 16, 2026 for the corresponding European patent application No. EP 23721862.3 (and an English machine translation).

Office Action mailed on May 5, 2026 for the corresponding Brazilian patent application No. BR 11 2024 019873-1 (and an English machine translation).

* cited by examiner

DEVICE FOR PROVIDING BRAIDS, SYSTEM COMPRISING THE DEVICE AND METHOD FOR PROVIDING BRAIDS

CROSS-REFERENCE TO RELATED APPLICATIONS

This patent application is a U.S. national stage application of international patent application PCT/EP2023/060513, filed on Apr. 21, 2023, which is based on and claims priority to German patent application DE 10 2022 110 418.4, filed on Apr. 28, 2022, the contents of which are incorporated herein by reference.

PRIOR ART

The invention concerns a device for providing nettings, a system and a method for providing nettings.

A device for providing nettings by means of a construction machine in mining and/or tunnel construction is already known from WO 2010/015339 A1.

The objective of the invention is in particular to provide a generic device having improved properties with regard to providing nettings. The objective is achieved according to the invention.

Advantages of the Invention

The invention is based on a device for providing nettings by means of a construction machine, in particular in mining and/or tunnel construction, having at least one netting receiving apparatus which is configured to receive and at least partially enclose a netting unit and which has a netting receiving opening and a netting output opening.

It is proposed that at least the netting output opening is equipped with at least one inhibiting element which is configured to prevent uncontrolled netting output. As a result, advantageous netting laying, in particular along tunnel or mining walls, can be made possible, which in particular manages without hydraulics, pneumatics and/or electronics. Controlled netting output, in particular using particularly simple means, can advantageously be achieved. Purely mechanical netting handling can advantageously be made possible. In particular, the netting receiving apparatus is configured to receive a netting unit and to provide it for processing, in particular for fastening the netting unit to a wall, for example a tunnel wall and/or a mine wall and/or an adit wall and/or a mountain wall or a comparable structure. In particular, the netting unit comprises the netting to be provided. In particular, the netting unit is configured as a netting roll. Alternatively, however, the netting unit could also be of a shape which deviates from a roll, for example as a folded netting stack or the like. In particular, the netting unit comprises at least one, preferably precisely one, netting web. In this case, the netting web is preferably substantially longer than wide. Typical lengths of netting webs are, for example, 15 m, 20 m, 25 m or 30 m. Typical widths of netting webs are, for example, 2 m, 2.5 m, 2.7 m or 3 m. In particular, the netting is designed as a steel wire netting, preferably as a steel mesh wire netting. In particular, the netting is designed from at least one high-tensile steel wire. In this case, a "high-tensile steel wire" should be understood to mean, in particular, a steel wire having a tensile strength of at least 800 N/mm$^2$, preferably of at least 1200 N/mm$^2$, advantageously of at least 1770 N/mm$^2$, preferably of at least 2200 N/mm$^2$ and particularly preferably of at most 3000 N/mm$^2$. In particular, the netting forms a safety net which, in the installed state, is configured to prevent a rockfall or the like and/or to reduce the effects thereof. In particular, the netting is formed from a plurality of flat helices which are braided into one another and of which at least one helix is produced from at least one individual wire, a wire bundle, a wire strand, a wire rope and/or another longitudinal element having at least one wire. However, alternative types of netting, such as hexagonal nettings or ring nettings, etc., are also conceivable. Preferably, the device is configured for providing what are known as TECCO™ nettings from Geobrugg AG (Romanshorn, Switzerland), in particular MINAX™ nettings (e.g., MINAX 80/4 or MINAX 80/3) from Geobrugg AG. "Configured" should be understood to mean, in particular, specially programmed, designed and/or equipped. The fact that an object is configured for a specific function should be understood to mean, in particular, that the object performs and/or carries out this specific function in at least one application state and/or operating state.

The construction machine can be designed as a tunnel construction machine, preferably as a bolter or as a jumbo, or else as a separate machine which is specifically configured for holding the netting receiving apparatus. In particular, the construction machine has at least one boom. In particular, the netting receiving apparatus is configured to be mounted on the boom, in particular on one end of the boom. In particular, the netting receiving apparatus is configured to be moved along a tunnel wall or the like by means of the boom of the construction machine. In particular, the netting receiving apparatus can be aligned in any desired position and/or location with respect to the wall in order to provide the nettings. In particular, the netting receiving apparatus provides the netting for extraction. In this case, the netting can be extractable manually or with aids, for example a second boom of the construction machine which is designed as a drilling arm. In particular, the netting receiving apparatus has a shape which allows at least one netting unit to be received, in particular inserted and/or suspended. In particular, the netting receiving apparatus encloses the at least one netting unit, in particular a netting unit which is configured as a netting roll, at least partially, preferably at least to a large extent, at least in the circumferential direction. In this context, a large part should be understood to mean, in particular, 60%, preferably 75%, preferably 90% and particularly preferably 95%. For this purpose, the netting receiving apparatus can have, for example, an at least substantially cylindrical shape. In this case, it is conceivable for cover surfaces of the cylindrical shape to be of closed or open or at least openable design. If the cover surfaces are of openable design, a lateral introduction of netting units would be conceivable. However, an arrangement of the netting receiving opening on the circumference of the cylindrical shape is preferred.

In particular, the netting receiving apparatus is formed from a metallic material, for example from a steel. In particular, the netting receiving apparatus is formed from a structurally rigid, in particular flexurally rigid, material. In particular, the material of the netting receiving apparatus is selected in such a way that even a falling back-and-forth of the netting unit in the netting receiving apparatus during an installation movement of the netting receiving apparatus cannot cause any damage, such as bendings, etc. In particular, the netting receiving apparatus has a weight of less than 200 kg, preferably of less than 150 kg and preferably of less than 100 kg. In particular, the netting receiving apparatus has a load-bearing capacity for netting units of more than 500 kg, preferably of more than 750 kg and preferably of more than 1000 kg. In particular, the netting receiving apparatus is configured at least for receiving netting rolls having a length of approximately 2.7 m, a diameter of approximately 0.7 m and/or a weight of approximately 210 kg. In particular, the netting receiving apparatus forms an unrolling unit for steel wire nettings provided in a rolled-up state. In particular, the netting receiving apparatus has a center of gravity which lies in a vicinity of the boom of the construction machine and/or of a mounting point of the netting receiving apparatus for mounting on the construction machine. In this case, the term "vicinity" should be understood to mean, in particular, a region formed from points, wherein each point lies at a distance of at most 0.5 m, preferably at most 0.3 m, from the boom of the construction machine and/or from the mounting point of the netting receiving apparatus. In particular, the netting receiving apparatus can be configured as a type of cage. Alternative implementations, for example having at least partially closed walls, are conceivable.

In particular, the netting receiving opening is arranged on a radial circumference of the netting receiving apparatus, in particular on a cylinder sheat of the cylindrical shape. In particular, the netting receiving opening has an elongate shape. In particular, an extension of the netting receiving opening in the axial direction of the netting receiving apparatus is at least twice as large, preferably at least three times as large and particularly preferably at least four times as large as an extension in a direction perpendicular to the axial direction of the netting receiving apparatus (circumferential direction). In particular, the netting receiving opening has dimensions which allow the netting unit to be inserted easily into a netting receiving space of the netting receiving apparatus, for example at least 2.5 m×1 m. In particular, the netting receiving opening is designed as a recess and/or opening in the netting receiving apparatus, wherein the opening and/or recess can be formed as the non-enclosing part of the netting receiving apparatus. In particular, the netting receiving opening could be at least partially closed. In particular, the open state could be configured to allow the netting unit to be inserted and/or removed. In particular, the closed state could be configured to hold the netting unit in the netting receiving apparatus, in particular to prevent it from falling out. In particular, the netting dispensing opening is arranged on a radial circumference of the netting receiving apparatus, in particular on a cylindrical sheat of the cylindrical shape. In particular, the netting dispensing opening has an elongate shape. In particular, the netting dispensing opening has a slot-like design. In particular, an extension of the netting dispensing opening in the axial direction of the netting receiving apparatus is at least four times as large, preferably at least seven times as large and particularly preferably at least ten times as large as a further extension in a direction perpendicular to the axial direction of the netting receiving apparatus (circumferential direction). In particular, the netting receiving opening has dimensions which allow the netting of the netting unit to be dispensed areally from the netting receiving space of the netting receiving apparatus, for example at least 2.5 m×0.2 m. In particular, the netting dispensing opening is formed by the netting receiving opening. In particular, the netting dispensing opening is designed to be smaller than the netting receiving opening. In particular, the netting dispensing opening is designed as a part of the netting receiving opening.

In particular, the netting of the netting unit is provided by the netting dispensing opening. In particular, the netting unit which is inserted into the netting receiving apparatus is partially unrolled for the purpose of being provided and is guided through the netting dispensing opening. In particular, a netting unit which is inserted into the netting receiving apparatus can be extracted from the netting dispensing opening. In particular, the inhibiting element is configured to prevent automatic unrolling/automatic dispensing of the netting, for example by gravity. In particular, the inhibiting element is configured to hold the netting in a substantially fixed unrolled state/extracted state. In particular, the inhibiting element is designed differently from the netting receiving apparatus. In particular, the inhibiting element is formed from a different material than the netting receiving apparatus. In particular, the inhibiting element is configured to provide the netting in a controlled and/or controllable manner. It is conceivable for the netting receiving apparatus to have a plurality of inhibiting elements, in particular two, three or more than three inhibiting elements. In particular, the number and/or implementation of the inhibiting elements can depend on the size and/or the weight of the netting unit, and also further properties of the netting unit and/or of the netting receiving apparatus. In particular, the inhibiting element forms a type of lip of the netting dispensing opening. In particular, the inhibiting element sweeps over the netting from at least one side during the dispensing of the netting. In particular, the inhibiting element produces fixing of the netting in a current dispensing position, for example by means of a frictional force. In particular, the inhibiting element clamps the netting to the netting receiving apparatus or to a further inhibiting element.

Furthermore, it is proposed that the inhibiting element is of elastic design. As a result, simple, preferably hydraulic-, pneumatic- and/or electronic-free, inhibition of the netting can advantageously be achieved. Different types of netting can advantageously be inhibited. Damaging of the netting unit during netting output can advantageously be at least substantially avoided and/or prevented. A strength of the inhibition by the inhibiting element can advantageously be set precisely, for example by a choice of elasticity. In particular, the inhibiting element is formed from an elastic material, in particular a plastic, a rubber, a metallic material, such as, for example, a (high-tensile) steel sheet or plates/sheets made of other ferrous or nonferrous metals (e.g. an aluminum block), and/or a wood material, such as, for example, an elastic chipboard and/or a particularly elastic type of wood, such as ash, hickory or elm. It is also conceivable for the inhibiting element to be formed from a composite material, for example a type of brake pad, as is known in particular from vehicle construction, and/or a (composite) nonwoven. It is also conceivable for the inhibiting element to be formed as a (metallic) spring which is configured to generate a pressing, in particular on account of the spring-elastic properties of the spring element, on the netting unit. The inhibiting element is preferably formed as a plate and/or slotted plate. It is additionally conceivable for the inhibiting element to be formed in the shape of a brush and/or a block and/or a ring and/or a disk. Alternatively, the inhibiting element can also be formed from a plasticoelastic material (cf. joint sealing material). In particular, the inhibiting element can be deflected flexibly out of a rest position. In particular, the inhibiting element is deflected by the netting during netting output. In particular, the inhibiting element is in the rest position when the netting dispensing opening is free of a netting. In particular, the inhibiting element is in an elastically deflected position/state when a netting is guided out of the netting dispensing opening.

Furthermore, it is proposed that the inhibiting element is configured to apply a pressing to at least part of the netting.

As a result of the pressing, netting output can advantageously be controlled and/or suppressed in a particularly simple, preferably hydraulic-, pneumatic- and/or electronic-free manner. A particularly high ease of use of the device for providing nettings can advantageously be achieved. Simple handling of netting units can advantageously be made possible. In particular, the pressing generated by the inhibiting element presses the netting against an edge of the netting dispensing opening. Alternatively, the pressing can also press the netting against an opposite inhibiting element. In particular, the inhibiting element applies the pressing to one of the two flat sides of the netting. In particular, the inhibiting element applies the pressing to an inner flat side of the netting or to an outer flat side of the netting. In particular, the inner flat side of the netting is designed as the side which, in the rolled-up state in a netting roll, faces a roll-up axis of the netting roll. In particular, the outer flat side of the netting is designed as the side which, in the rolled-up state in a netting roll, faces away from the roll-up axis of the netting roll. In particular, a plurality of inhibiting elements can be arranged for instance along a common line. Alternatively, an offset between individual, for example between adjacent, inhibiting elements can also be provided. In particular, the inhibiting elements are arranged without overlap with respect to one another. Alternatively, however, an at least partial overlap of adjacent inhibiting elements is also conceivable.

Furthermore, it is proposed that the inhibiting element is configured to apply the pressing to at least that part of the netting which is currently emerging from the netting output opening. As a result, effective inhibition for preventing self-rolling can advantageously be achieved. Fixing of the netting close to an emergence point from the netting receiving apparatus can advantageously be achieved, as a result of which, in particular, handling of the netting during application to a surface can be simplified. In particular, the inhibiting element is arranged in a vicinity of the netting dispensing opening, in particular of an edge of the netting dispensing opening. In this case, a "vicinity" should be understood to mean, in particular, a region which is formed by points which are at a distance of at most 25 cm, preferably at most 15 cm and preferably at most 7 cm, from an edge of the netting dispensing opening. Alternatively or additionally, however, it is also conceivable that an inhibiting element is arranged in an interior of the netting receiving apparatus and exerts a pressing on a still rolled-up part of a netting roll.

In addition, it is proposed that the inhibiting element is arranged on the netting receiving apparatus in such a way that, at least in an unloaded state, the inhibiting element covers the netting dispensing opening at least in sections at least for the most part. As a result, effective inhibition for preventing self-rolling can advantageously be achieved, in particular in a technically particularly simple and/or cost-effective manner. In particular, the inhibiting element is arranged on the netting receiving apparatus in such a way that, when the netting emerges from the netting dispensing opening, the netting must elastically deform the inhibiting element, for example bend away from the netting dispensing opening. In the unloaded state, the inhibiting element preferably completely overlaps the netting dispensing opening at least in a spatial direction, in particular in a circumferential direction around the netting receiving apparatus. In particular, in the unloaded state, the netting receiving apparatus is empty or is equipped with a netting roll which has not been pulled out. In particular, the inhibiting element still partially overlaps/covers the netting dispensing opening even when the netting emerges from the netting dispensing opening. In particular, the inhibiting element only in sections overlaps/covers the netting dispensing opening in the axial direction of the netting receiving apparatus, in particular in the unloaded state and in a loaded state of the inhibiting element. In particular, the inhibiting element can be arranged on an upper side of the netting receiving opening, on a lower side of the netting receiving opening or on both opposite sides of the netting receiving opening. In principle, as an alternative or in addition, inhibiting elements which press laterally against the netting could also be provided.

If the inhibiting element is replaceably attached to the netting receiving apparatus, repair and/or maintenance can advantageously take place in a very simple manner. A high ease of use can advantageously be achieved. The inhibiting element can, for example, be screwed to the netting receiving apparatus or clamped to the netting receiving apparatus or plugged onto the netting receiving apparatus, for example by means of a snap closure and/or a quick-release fastener. In particular, the inhibiting element is non-destructively replaceable. In particular, the inhibiting element forms a wear part.

Furthermore, it is proposed that the netting receiving apparatus has at least one, in particular movably supported, closure element for at least partially closing the netting receiving opening. As a result, secure reception of the netting unit can advantageously be achieved. In addition, simple filling of the netting receiving apparatus can advantageously be made possible. In particular, the closure element closes the netting receiving opening at least to such an extent that the netting unit cannot fall out of the netting receiving apparatus. In particular, the closure element only partially closes the netting receiving opening, in particular in the axial direction of the netting receiving apparatus and/or in the circumferential direction of the netting receiving apparatus. The closure element preferably closes the netting receiving opening in the circumferential direction by at least 80%, preferably by at least 90%. The closure element preferably closes the netting receiving opening in the axial direction by at most 25%, preferably by at most 15%. In particular, the closure element forms a closure slide, a cover and/or a flap. In particular, the closure element is formed from an at least substantially identical material to a remaining part of the netting receiving apparatus forming the netting receiving space.

If, in this case, the netting receiving apparatus has at least one guide rail which is configured to guide the closure element on a circumference of the netting receiving apparatus, a compact design and/or comfortable handling can advantageously be made possible. In addition, incorrect operation can advantageously be prevented.

If, in addition, the closure element in a closed state delimits the netting dispensing opening in sections, an overall weight of the netting receiving apparatus can advantageously be kept low. In addition, in particular manual operation of the closure element can advantageously remain easy to handle. In particular, the closure element has a grip element for manually adjusting the position of the closure element relative to the netting receiving apparatus.

Furthermore, it is proposed that the closure element, in particular a positioning of the closure element along the guide rail, is configured to adjust the pressing applied by the inhibiting element. As a result, a high degree of flexibility can advantageously be achieved. In addition, a high degree of readiness for use can advantageously be achieved, in particular by simple and/or rapid readjustment being made possible. In addition, a simple design can advantageously be achieved. In particular, a size of the netting dispensing opening in the circumferential direction can be achieved by adjusting a setting position of the closure element, as a result of which, in particular, a degree of a necessary bending of the inhibiting element for the netting dispensing opening to pass through a netting can be adjusted. In particular, the greater the elastic bending/deflection of the inhibiting element by the netting, the greater the pressing generated. In particular, a partially worn inhibiting element can be readjusted, in particular retensioned, by the positioning of the closure element.

In addition, it is proposed that the closure element is designed to be substantially narrower than the netting receiving opening and/or the netting dispensing opening in a main extension direction of the netting receiving opening and/or the netting dispensing opening. Material costs can advantageously be reduced. Particularly advantageously a weight of the netting receiving apparatus can be reduced. In this context, "substantially narrower" should be understood to mean, in particular, at least 50% narrower, preferably at least 70% narrower and preferably at least 85% narrower. A width of the closure element is preferably approximately one ninth of a width of the netting receiving opening. In particular, the netting receiving opening extends completely between two opposite axial end regions of the netting receiving apparatus.

Furthermore, it is proposed that the inhibiting element is arranged at a netting output opening-side end of the closure element. As a result, a simple design can advantageously be achieved. A particularly simple adjustment of the pressing force generated by the inhibiting element can advantageously be achieved. In particular, the inhibiting element extends beyond the netting output opening-side end of the closure element. In particular, the inhibiting element forms a netting output opening-side extension of the closure element.

Furthermore, it is proposed that the inhibiting element and/or the closure element has a width which corresponds to at least one mesh extent, preferably at least two mesh extents, of the netting configured for provision. As a result, the device can advantageously be operated in a trouble-free manner, in particular since the inhibiting element and the netting unit cannot become entangled. In addition, a particularly uniform inhibiting effect can advantageously be achieved over an entire web length of the netting unit. In particular, the width is an extension of the inhibiting element and/or of the closure element parallel to the axial direction of the netting receiving apparatus. In particular in the case of a mesh wire netting, such as, for example, the TECCO™ netting, the mesh extent is defined by a distance between two adjacent bending regions of a helix of the mesh wire netting and/or between two contact points of adjacent helices of the mesh wire netting. Customary distances of this type (i.e. customary minimum widths of inhibiting elements/closure elements) are 45 mm, 65 mm or 80 mm. The widths of the closure elements and of the inhibiting elements fastened thereto are preferably approximately the same size. Alternatively, however, a closure element can also carry a plurality of inhibiting elements arranged next to one another.

Furthermore, it is proposed that the netting receiving apparatus has at least one further closure element which is in particular at least substantially identical to the closure element. Secure reception of the netting unit can advantageously be achieved while maintaining as low a weight as possible and/or while maintaining as simple a handling as possible. In particular, three or more than three closure elements are also conceivable. In particular, the closure elements are arranged spaced apart from one another along the axial direction. It is conceivable for two or more closure elements to be connected to one another by means of a connecting element in order to advantageously allow the closure elements to be closed and opened easily and/or uniformly. Alternatively, however, each closure element can also be designed such that it can be operated individually. In particular, the closure elements are designed and/or dimensioned in such a way that each individual closure element or at least the combination of all closure elements is strong enough to carry a netting unit. In particular, during the movement of the device through the construction machine, the netting unit can also be displaced in such a way that its entire weight lies exclusively on the closure elements. In this case, too, secure holding of the netting unit in the netting receiving apparatus must be ensured.

If the netting receiving apparatus forms an at least substantially cylindrical netting receiving space which is configured to receive at least the netting unit, proper unrolling of netting units which are designed as netting rolls can advantageously be achieved. In addition, a high degree of stability and/or a high degree of compactness of the netting receiving apparatus can advantageously be achieved. In particular, orientation of the netting roll within the netting receiving space does not matter with regard to operability of the device.

Furthermore, if the netting receiving apparatus has a netting receiving space which is overwidth, in particular in relation to web widths of netting units which can be provided by the netting receiving apparatus, and which is configured to provide a tolerance range for varying packing widths of, in particular otherwise identically designed, netting units, a high ease of use can advantageously be achieved. In particular, reception of netting units can advantageously be simplified, in particular even if said netting units are not rolled up and/or stacked in a perfectly straight manner. In particular, the overwidth is at least 10%, preferably at least 15% and preferably at least 20% of a web width of a largest netting unit which can be provided by the netting receiving apparatus. If the netting receiving apparatus is configured, for example, for providing approximately 2.3 m wide (MINAX™ 80/4) netting rolls, the width of the netting receiving space is preferably approximately 2.7 m.

In addition, it is conceivable for the netting receiving apparatus to be of width-adjustable design. As a result, the dimensions of the netting receiving apparatus could advantageously be adapted to different construction machines and/or to different netting units.

If, in addition, at least one wall of the netting receiving apparatus has lightweight construction recesses, an overall weight can advantageously be kept low. In this case, the lightweight construction recesses can have different geometries, e.g. slots, holes, meshes, etc. In particular, the lightweight construction recesses are arranged distributed over at least a large part of an overall surface area of the netting receiving apparatus. In this context, a "large part" should be understood to mean, in particular, 60%, preferably 70%, preferably 80% and particularly preferably 90%.

Furthermore, it is proposed that the device has a protective unit which covers at least part of an outer side of the netting receiving apparatus in order to avoid injuries and/or soiling. A maintenance interval can advantageously be extended. A service life can advantageously be increased. Safety can advantageously be increased. In particular, the protective unit is configured as a tarpaulin, as a net, as a textile or as a comparable planar element. In particular, the protective unit is fastened to the outer side of the netting receiving apparatus. In particular, the protective unit has—if at all—substantially smaller openings than the netting receiving apparatus, with the result that dirt, for example (sprayed) mortar from tunnel construction fastening operations ("concrete rain") cannot penetrate into the netting receiving space and/or that no fingers or other body parts can penetrate into the netting receiving space.

In addition, it is proposed that the netting receiving apparatus has a support element for positioning the netting receiving apparatus on a base. The netting receiving apparatus can advantageously be set down safely, in particular in a stable manner, as a result. The netting receiving apparatus can advantageously be positioned with respect to a base by the support element in such a way that insertion into the netting receiving space and closure of the netting receiving space can be carried out as simply as possible. In particular, the support element is formed in one piece with the netting receiving apparatus. "In one piece" should be understood to mean, in particular, cohesively connected, for example by a welding process and/or adhesive bonding process etc., and particularly advantageously integrally formed, such as by production from a casting and/or by production in a single-component or multi-component injection molding process. "In one piece" should advantageously also be understood to mean in one piece/monolithically. "In one piece" should be understood to mean, in particular, formed in one piece.

Furthermore, it is proposed that at least one region of the netting receiving apparatus which delimits the netting receiving opening has a netting insertion aid element which is in particular configured to support an insertion of the netting unit into a netting receiving space of the netting receiving apparatus. The netting unit can advantageously be inserted and/or received into the netting receiving apparatus in a particularly simple manner, in particular even at least in a partially automated manner. In particular, the netting insertion aid element is designed as a bevel which is preferably arranged on a lower edge of the netting receiving opening in the installation direction, in particular on an edge facing the installation element. In particular, the netting insertion aid element is configured to provide the netting receiving apparatus with an excavator blade function when the netting receiving opening is open.

Furthermore, it is proposed that the netting receiving apparatus has a bearing unit for rotatably bearing netting roll central rods. A bearing of netting rolls in the netting receiving space and/or an unrolling of the netting rolls can advantageously be improved as a result. In particular, the bearing unit comprises at least two (round) receiving openings for netting roll central rods arranged opposite one another in the axial direction of the netting receiving apparatus at lateral ends of the netting receiving apparatus.

In addition, it is proposed that the netting receiving apparatus has a fastening unit for fastening to the construction machine. Simple mounting can advantageously be made possible as a result. In particular, the fastening unit is located in the vicinity of the center of gravity of the netting receiving apparatus. In particular, the fastening unit forms the mounting point of the netting receiving apparatus. In particular, the netting receiving apparatus is reinforced in the region of the fastening unit.

In addition, it is proposed that the netting receiving apparatus has stiffening elements which extend parallel to a main extension direction of the netting receiving apparatus. A design can advantageously be improved. A stiffness can advantageously be increased. A weight can advantageously be reduced.

As an alternative to a plate-like design of the inhibiting element, it is proposed that the inhibiting element is designed as a roll. Guiding of the netting output can advantageously be achieved as a result. It is additionally conceivable for the above-described elastic, e.g. plate-like, inhibiting elements to be additionally equipped, in end regions, with rolls for guiding the nettings. Protection against copying can advantageously also be achieved by the rolls, in particular in that they are designed and/or arranged in such a way that only nettings having specific mesh shapes and/or having specific mesh sizes can be reliably output from the respective netting receiving apparatus by the rolls. The rolls could advantageously not be designed such that they can be removed non-destructively from the closure elements.

Furthermore, it is proposed that the device has a plurality of inhibiting elements which are designed as rolls and are arranged in accordance with a mesh extent (mesh width) or a half mesh extent (mesh width) of the netting unit configured for provision. A type of protection against copying can advantageously be achieved as a result.

Furthermore, a system having the device and having at least one netting unit, in particular a netting roll, and having a construction machine configured for laying nettings is proposed, wherein the device is fixedly connected to the construction machine. As a result, advantageous netting laying, in particular along tunnel or mining walls, can be made possible, which in particular manages without hydraulics, pneumatics and/or electronics. In particular, the device can be rotated as desired on the boom of the construction machine, in particular through 360° and more, without the operability being impaired or the netting unit threatening to fall out of the netting receiving apparatus.

In addition, a method for providing nettings, in particular in mining and/or tunnel construction, by means of the device or by means of the system is proposed, wherein an uncontrolled netting output is prevented in at least one method step. As a result, advantageous netting laying, in particular along tunnel or mining walls, can be made possible, which in particular manages without hydraulics, pneumatics and/or electronics.

DRAWINGS

Further advantages result from the following description of the drawings. Exemplary embodiments of the invention are illustrated in the drawings. The drawings, the description and the claims contain numerous features in combination. The person skilled in the art will expediently also consider the features individually and combine them to form meaningful further combinations.

Figure 2:
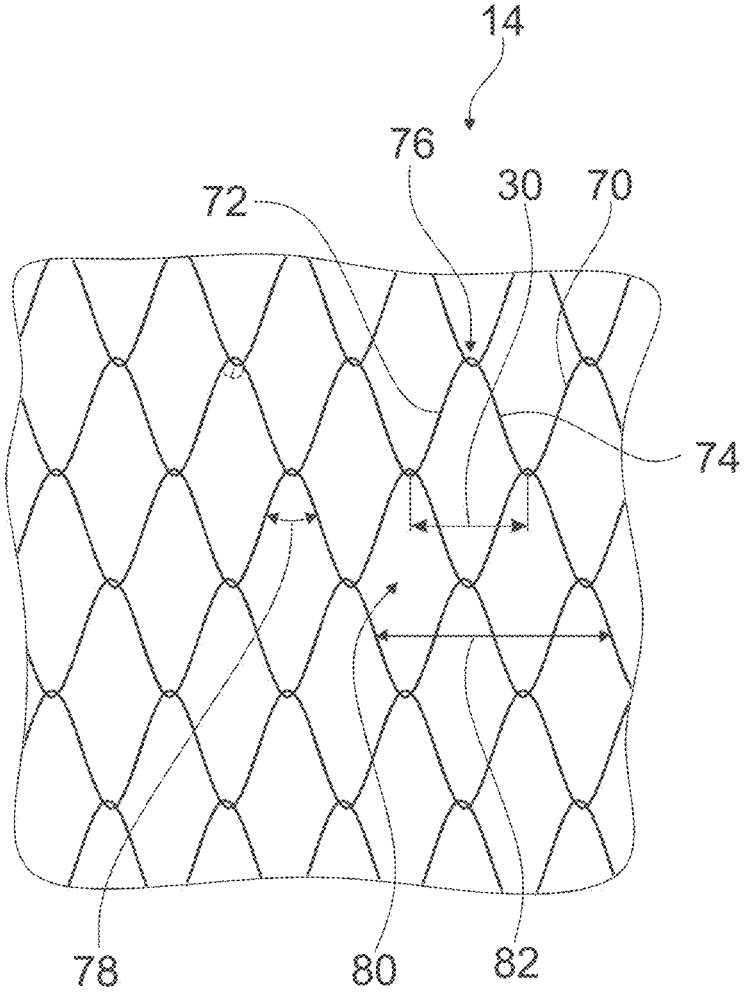
Figure 3:
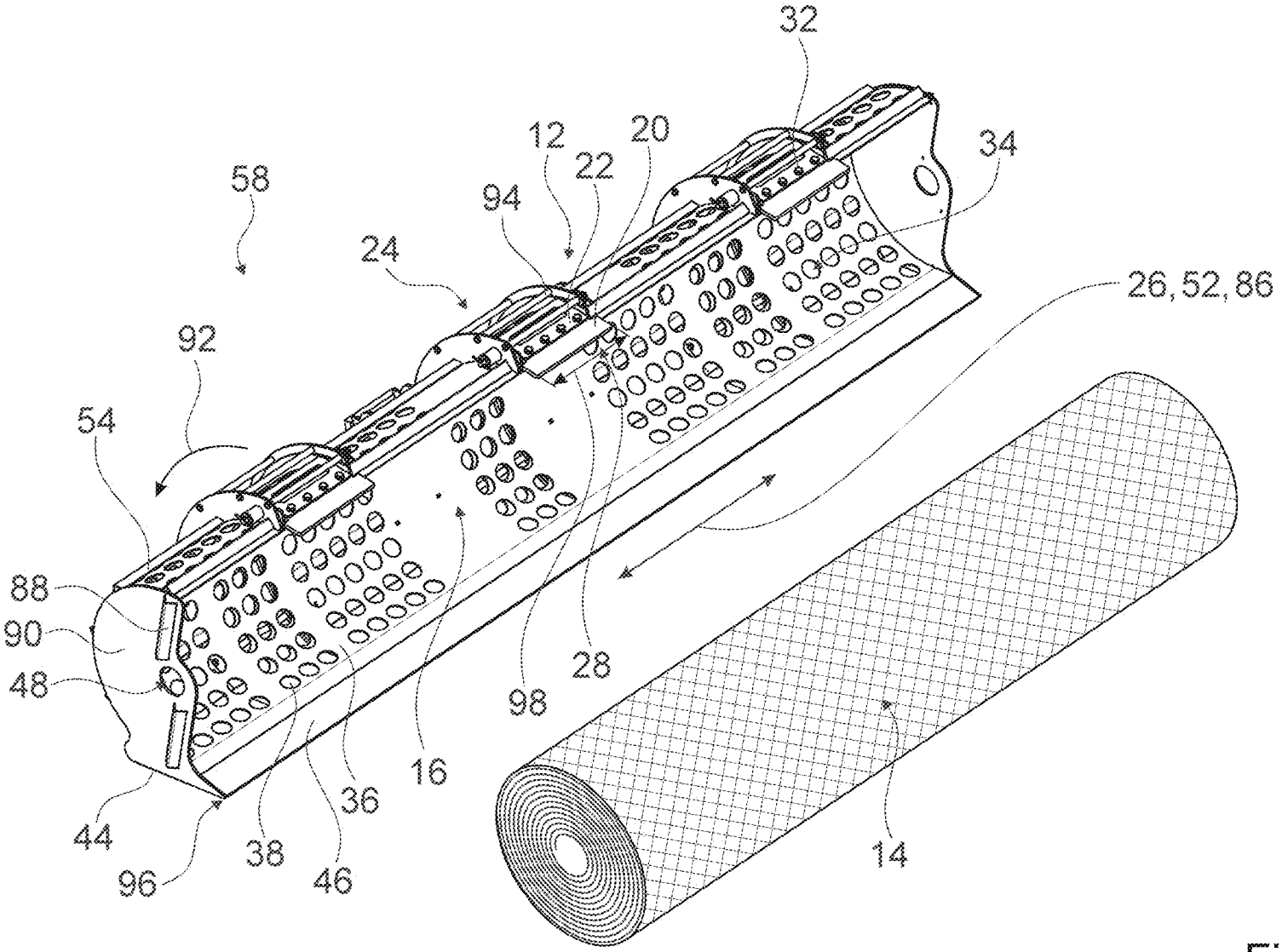
Figure 4:
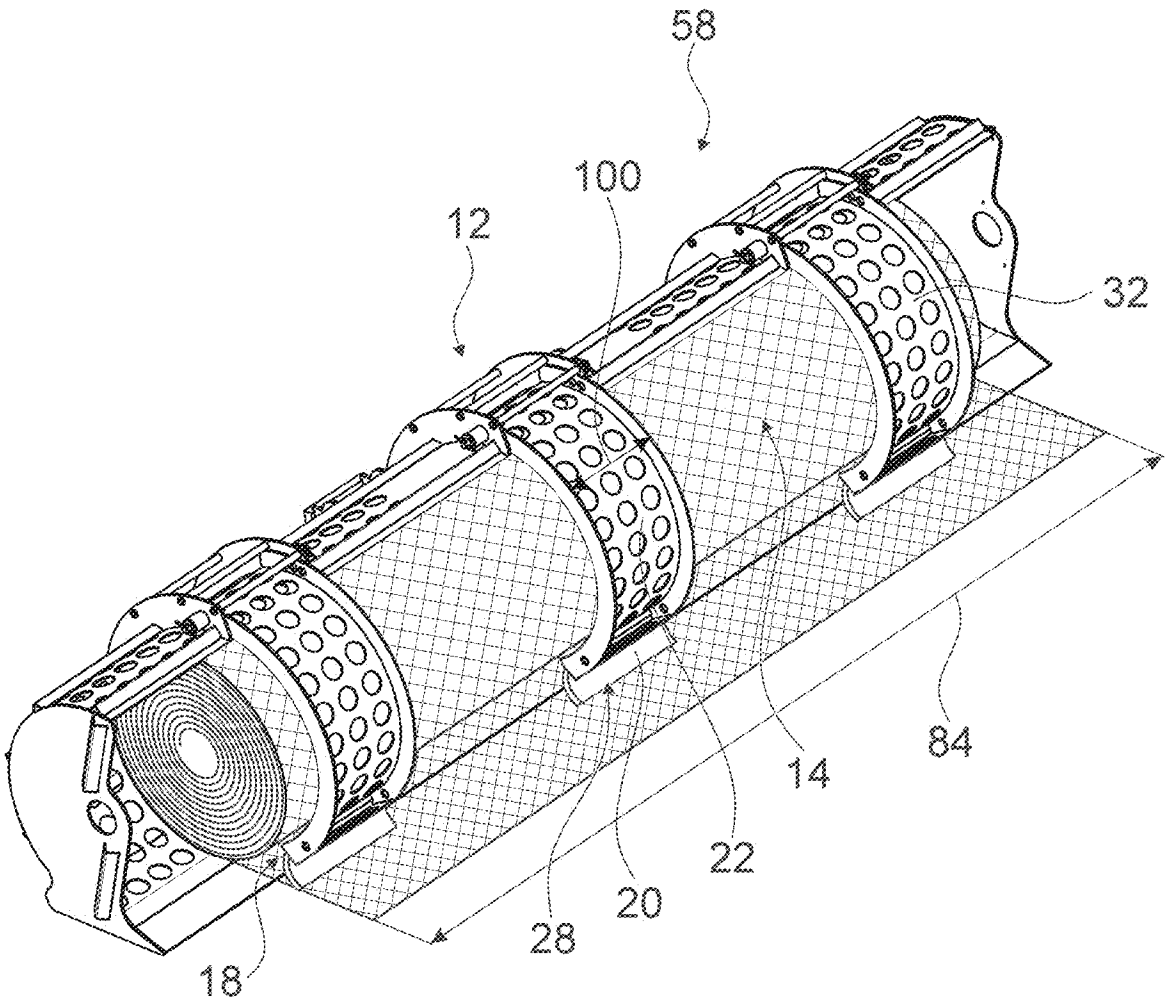
Figure 5:
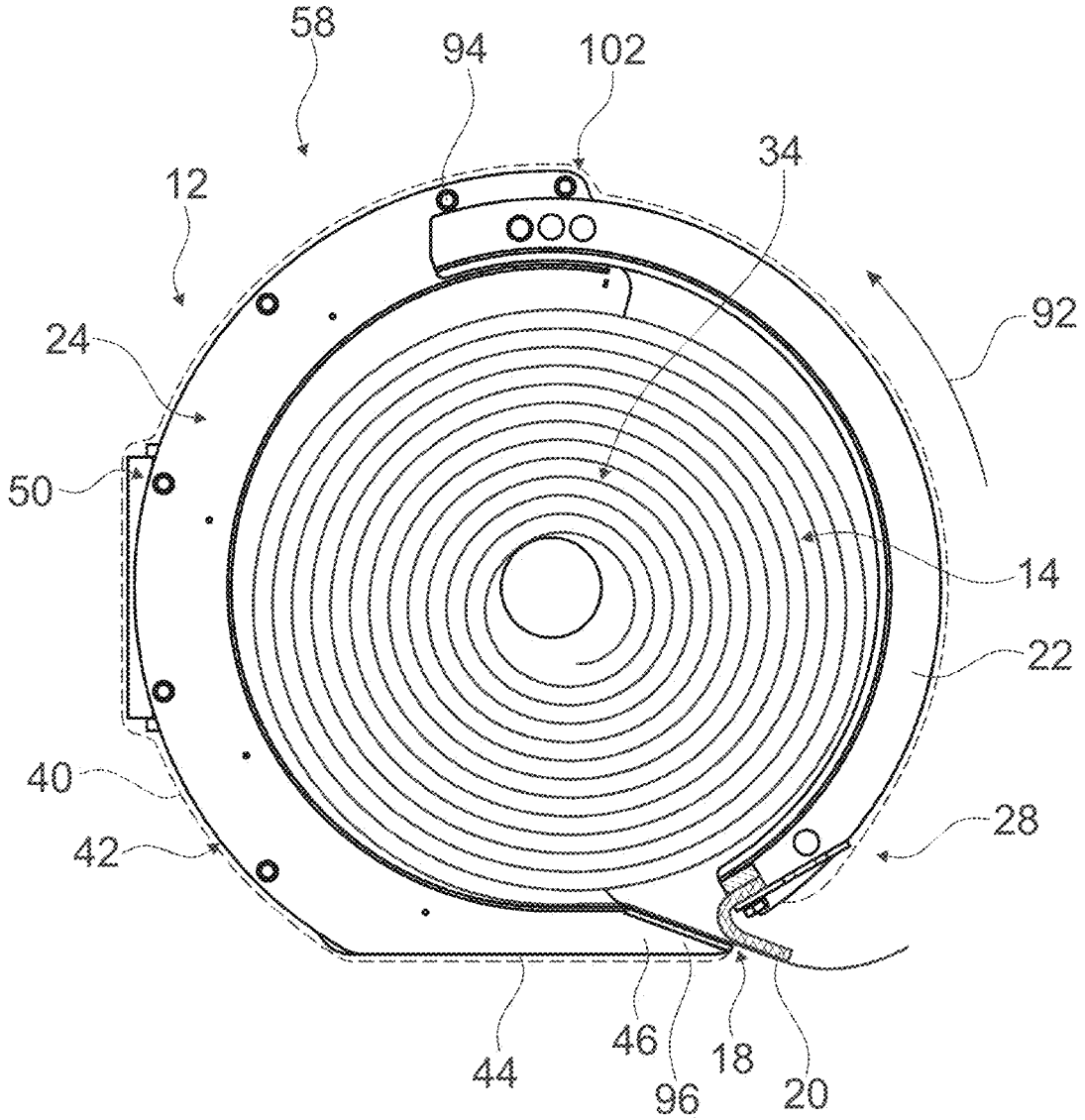
Figure 6:
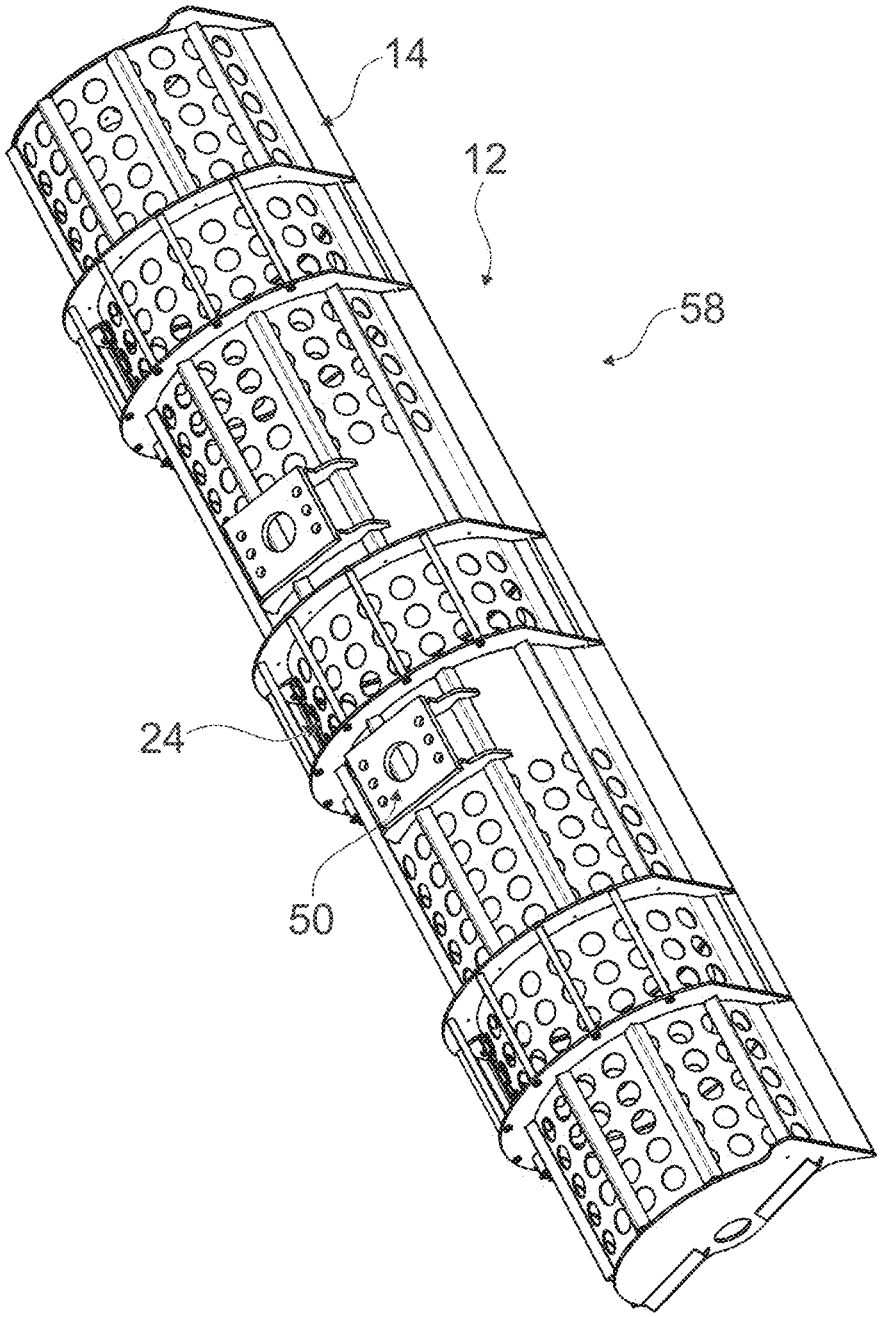
Figure 7:
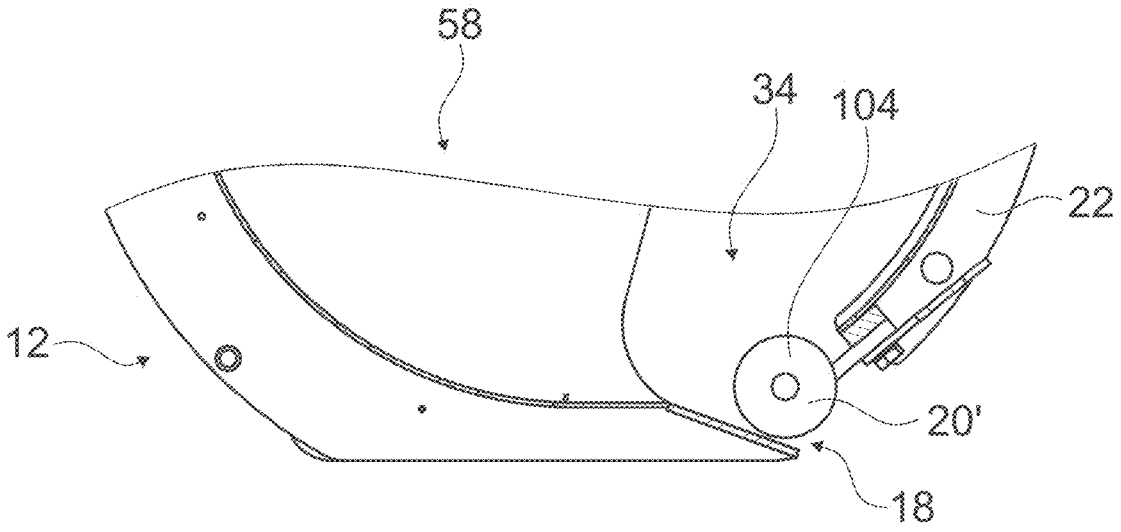
Figure 8:
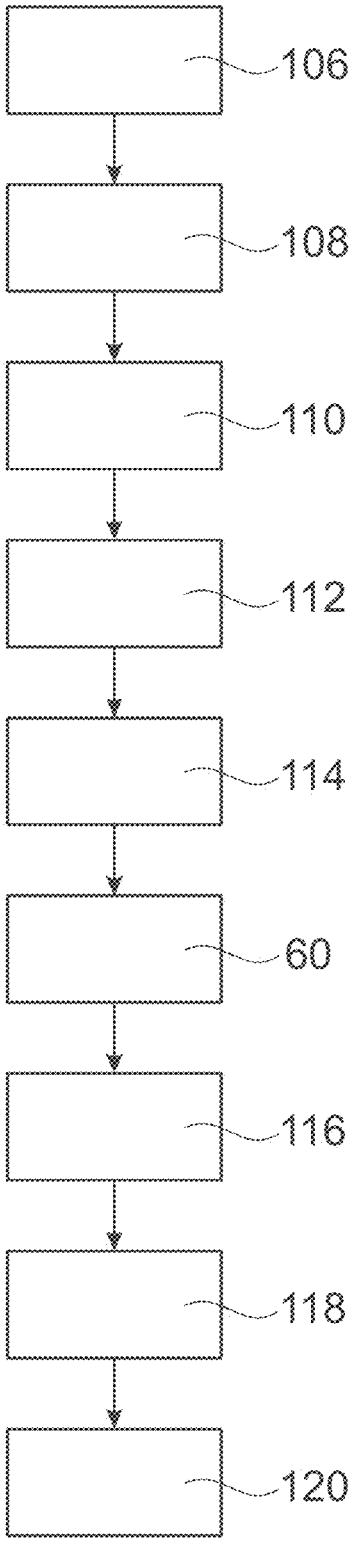

In the drawings:

FIG. 1 shows a schematic illustration of a system for laying nettings in mining and/or in tunnel construction having a device, a netting unit and a construction machine, FIG. 2 shows a schematic view of a detail of the netting of the netting unit, FIG. 3 shows a schematic perspective view of the netting unit and the device with a netting receiving apparatus having open closure elements, FIG. 4 shows a further schematic perspective view of the device with the netting receiving apparatus, wherein the netting unit is arranged in a netting receiving space of the netting receiving apparatus and wherein the closure elements are closed, FIG. 5 shows a schematic vertical sectional illustration of the device with the netting receiving apparatus and with a protective unit, FIG. 6 shows a schematic perspective rear view of the netting receiving apparatus, FIG. 7 shows a part of a schematic vertical sectional illustration of the device with the netting receiving apparatus, the closure element of which is equipped with an alternative inhibiting element, and FIG. 8 shows a schematic flow diagram of a method for providing nettings in mining and/or tunnel construction.

DESCRIPTION OF THE EXEMPLARY EMBODIMENTS

FIG. 1 shows a schematic illustration of a system 56 for laying nettings in mining and/or in tunnel construction. The system 56 has a construction machine 10. The construction machine 10 is designed as a bolter/jumbo. The construction machine 10 is configured for drilling holes in rock walls 68. The construction machine 10 is modified in such a way that it is additionally configured for laying the nettings. The system 56 has a device 58. The device 58 is fixedly connected to the construction machine 10. The construction machine 10 has a boom 62. The device 58 is fastened to the boom 62. The device 58 is fastened to the boom 62 instead of a drill. The device 58 is fastened to the outermost end of the boom 62. The construction machine 10 has a further boom 64. The further boom 64 has a drill 66. The further boom 64 is configured for fastening the nettings to the rock wall 68. The device 58 is configured for providing the nettings for mounting on the rock wall 68. The system 56 has a netting unit 14. The netting unit 14 is configured as a netting roll. The construction machine 10 is configured to move the device 58 along the rock wall 68 and in the process to unroll the netting roll for dispensing the netting. Meanwhile, the drill 66 fastens the netting, which has already been unrolled, to the rock wall 68.

FIG. 2 shows a schematic view of a detail of the netting of the netting unit 14. The netting is designed as a wire net. The wire of the wire net is formed by a high-tensile steel. The netting is designed as a safety net for securing against small rockfall/rockfall. The netting has a plurality of helices 70. The helices 70 engage in one another in each case. The helices 70 are braided into one another. The helices 70 are aligned parallel to one another. The helices 70 each have the shape of a flattened helix. The helices 70 each have a sequence of alternating legs 72, 74. The helices 70 each have bending regions 76. A bending region 76 connects two legs 72, 74 of a helix 70 in each case. In the tensioned state of the netting, mutually engaging helices 70 touch one another in a vicinity of the bending regions 76, preferably at the bending regions 76. The legs 72, 74 each span a bending angle 78. The bending angle 78 is less than 90°. The netting forms a diamond-shaped mesh shape 80. The netting has a mesh extent 30. The mesh extent 30 corresponds to a width of the diamond-shaped mesh shape 80 parallel to a longitudinal direction 82 of the helices 70. The helices 70 are each formed from an individual wire. Alternatively, helices 70 could also be formed from a wire bundle, a wire strand, a wire rope and/or another longitudinal element.

FIG. 3 shows a schematic perspective view of the device 58 for providing nettings by means of the construction machine 10. In addition, FIG. 3 schematically shows a netting unit 14 which is configured as a netting roll. The device 58 has a netting receiving apparatus 12. The netting receiving apparatus 12 is configured to receive the netting unit 14. The netting receiving apparatus 12 is configured to partially enclose the received netting unit 14 (see also FIG. 4). The netting receiving apparatus 12 forms a netting receiving space 34. The netting receiving space 34 is of approximately cylindrical shape. The netting receiving space 34 is configured to receive the netting unit 14. The netting receiving space 34 of the netting receiving apparatus 12 is designed to be overwidth in relation to a web width 84 of a netting unit 14 which can be provided by the netting receiving apparatus 12. As a result of the overwidth, the netting receiving space 34 provides a tolerance range for varying packing widths of otherwise identically designed netting units 14.

The netting receiving apparatus 12 delimits the netting receiving space 34 by walls 36, 90. The walls 36, 90 of the netting receiving apparatus 12, in particular the walls 36 which delimit the receiving space in the circumferential direction 92, have lightweight construction recesses 38. The lightweight construction recesses 38 are configured as round holes/bores/punchings. However, other shapes are also conceivable. The netting receiving apparatus 12 has a support element 44. The support element 44 is configured for positioning the netting receiving apparatus 12 on a base. The support element 44 forms a planar support surface and/or positioning feet on the otherwise cylindrical circumference of the netting receiving apparatus 12. The netting receiving apparatus 12 has a bearing unit 48 for optionally rotatably bearing netting roll central rods (not illustrated)—if these are present. The bearing unit 48 is formed by holes arranged opposite one another in the axial direction 86 of the netting receiving apparatus 12 in the walls 90 which delimit the netting receiving apparatus 12 in the axial direction 86. The netting receiving apparatus 12 has stiffening elements 54, 88. A part of the stiffening elements 54 extend parallel to a main extension direction 52 of the netting receiving apparatus 12. The stiffening elements 54 which extend parallel to the main extension direction 52 of the netting receiving apparatus 12 are arranged on a wall 36 which delimits the netting receiving space 34 in the circumferential direction 92. A further part of the stiffening elements 88 extend perpendicularly to the main extension direction 52 of the netting receiving apparatus 12. The stiffening elements 88 which extend perpendicularly to the main extension direction 52 of the netting receiving apparatus 12 are arranged on a wall 90 which delimits the netting receiving space 34 in the axial direction 86.

The netting receiving apparatus 12 forms a netting receiving opening 16. The netting receiving opening 16 forms an access for introducing the netting unit 14 into the netting receiving space 34. The netting receiving opening 16 can be partially closed. The netting receiving apparatus 12 has a closure element 22. The closure element 22 is configured to partially close the netting receiving opening 16. The closure element 22 is movably supported. The closure element 22 is displaceably supported in the circumferential direction 92. The closure element 22 is manually displaceable. To simplify the manual displaceability of the closure element 22, grip elements (not illustrated) can be provided. The netting receiving apparatus 12 has a guide rail 24. The guide rail 24 is configured to guide the closure element 22 on the circumference of the netting receiving apparatus 12. The guide rail 24 is covered by transverse struts 94. The transverse struts 94 serve for captive holding of the closure element 22 in the guide rail 24. The transverse struts 94 serve for reinforcement/stiffening of the netting receiving apparatus 12. The closure element 22 is substantially narrower than the netting receiving opening 16 in a main extension direction 26 of the netting receiving opening 16. The closure element 22 has a width 100 which corresponds to at least one mesh extent 30 of the netting configured for provision.

The netting receiving apparatus 12 has a further closure element 32. The further closure element 32 is at least substantially identical to the closure element 22. In the exemplary embodiment illustrated in the figures, the netting receiving apparatus 12 has a total of three closure elements 22, 32, wherein more or less are also conceivable. The closure elements 22, 32 are arranged and/or designed in such a way that a netting unit 14 (see also FIG. 4) which is arranged in the netting receiving space 34 cannot fall out of the netting receiving space 34 irrespective of a spatial position of the netting receiving apparatus 12. In FIG. 3, the closure elements 22, 32 are illustrated in a completely open position. The netting receiving apparatus 12 has a netting insertion aid element 46. The netting insertion aid element 46 is arranged in a region of the netting receiving apparatus 12 which delimits the netting receiving opening 16. The netting insertion aid element 46 is arranged in an edge region of the netting receiving opening 16 which faces the support element 44. The netting insertion aid element 46 is configured to support an insertion of the netting unit 14 into the netting receiving space 34. The netting insertion aid element 46 is designed as a bevel 96. The bevel 96 tapers the netting receiving apparatus 12 towards the netting receiving opening 16. In the position of the netting receiving apparatus 12 in which it is set up on the support element 44, the bevel 96 forms a type of ramp for the insertion of the netting unit 14. The netting receiving apparatus 12 can be used by the netting insertion aid element 46 in a manner of an excavator blade when the closure elements 22, 32 are open. The netting insertion aid element 46, in particular the bevel 96, extends over the entire axial length of the netting receiving opening 16, in particular of the netting receiving apparatus 12.

FIG. 4 shows a further schematic perspective view of the device 58 for providing nettings by means of the construction machine 10, wherein the closure elements 22, 32 are positioned in a position in which they close the netting receiving opening 16. In this state, the netting receiving apparatus 12 forms a netting dispensing opening 18 which, in particular, is of different size than the netting receiving opening 16 described above. The netting dispensing opening 18 is of slot-like design. The netting dispensing opening 18 overlaps with the netting receiving opening 16. A lower edge (located in the direction of the support element 44) of the netting receiving opening 16 likewise forms a lower edge of the netting dispensing opening 18. However, an upper edge (as seen in the installation direction of the netting receiving apparatus 12) of the netting receiving opening 16 is different from an upper edge of the netting dispensing opening 18. The upper edge of the netting dispensing opening 18, as seen in the installation direction of the netting receiving apparatus 12, is formed/delimited substantially by netting output opening-side ends 28 of the closure elements 22, 32. In a closed state, the closure elements 22, 32 directly partially delimit the netting dispensing opening 18.

The netting receiving apparatus 12 has an inhibiting element 20. The netting dispensing opening 18 is equipped with the inhibiting element 20. The inhibiting element 20 is configured to prevent uncontrolled netting output of the netting unit 14 introduced into the netting receiving space 34. The inhibiting element 20 is configured to prevent automatic unrolling of the netting roll. The inhibiting element 20 is configured to allow tensioning of the netting by a movement of the netting receiving apparatus 12 along the rock wall 68. The inhibiting element 20 is arranged at the netting output opening-side end 28 of the closure element 22. Here, the inhibiting element 20 is replaceably attached to the netting receiving apparatus 12, in particular to the closure element 22. The inhibiting element 20 has a width 98 which corresponds to at least the mesh extent 30 of the netting configured for provision. In the case illustrated, the width 98 of the inhibiting element 20 corresponds approximately to the width 100 of the closure element 22. However, deviations in the widths 98, 100 and/or arrangements with a plurality of inhibiting elements 20 on a closure element 22 are likewise conceivable. Each of the closure elements 22, 32 is equipped with one or more inhibiting elements 20 on the netting output opening side.

The inhibiting element 20 is arranged on the netting receiving apparatus 12, in particular the closure element 22, in such a way that, in an unloaded state (i.e. in a state in which the netting does not emerge through the netting dispensing opening 18), the inhibiting element 20 completely covers the netting dispensing opening 18 in a portion which corresponds to the width 98 of the inhibiting element 20. The unloaded closed state is not illustrated in the figures. In FIG. 4, the netting is partially pulled out of the netting receiving space 34, that is to say passes through the netting dispensing opening 18. The inhibiting element 20 is of elastic design. The inhibiting element 20 is formed from a rubber material. The inhibiting element 20 is designed as a rubber plate. The elastic inhibiting element 20 is elastically bent/elastically deflected by the netting emerging from the netting dispensing opening 18 (see also FIG. 5). The inhibiting element 20 is configured to apply a pressing to part of the netting. By virtue of the fact that the inhibiting element 20 wishes to return to its rest position/its initial shape by virtue of its elasticity, the inhibiting element 20 produces the pressing on that part of the netting which is in touch contact with the inhibiting element 20. Consequently, the inhibiting element 20 is configured to always apply the pressing to that part of the netting which is currently emerging from the netting dispensing opening 18. By virtue of the arrangement of the inhibiting element 20 at the netting output opening-side end 28 of the closure element 22, the closure element 22 is configured to adjust the pressing applied by the inhibiting element 20. The smaller the netting dispensing opening 18 is selected by the adjustment of the closure element 22, the stronger/narrower the inhibiting element 20 has to be bent by the netting emerging from the netting dispensing opening 18.

FIG. 5 shows a schematic vertical sectional illustration of the device 58 with the netting receiving apparatus 12. The closure element 22 is in a closed state. The netting roll which is arranged in the netting receiving space 34 is illustrated as partially pulled out of the netting dispensing opening 18. The inhibiting element 20 is strongly deformed/bent outward by the pulling out of the netting. The inhibiting element 20 consequently presses the netting against an opposite edge of the netting dispensing opening 18, in particular against the netting insertion aid element 46/the bevel 96. The closure element 22 is fixed at an end 102 facing away from the netting output opening-side end 28 on a main body of the netting receiving apparatus 12/on the guide rail 24. By way of example, a bolt fixing of the closure element 22 is shown in FIG. 5. However, alternative fixing methods are of course conceivable. The closure element 22 can be fixed in different closed positions which each bring about slightly different (vertical) sizes of the netting dispensing opening 18. As a result, a strength of the pressing/inhibition generated by the inhibiting element 20 can be set and/or a partially worn inhibiting element 20 can be readjusted, depending on the choice of the closed position of the closure element 22.

The device 58 has a protective unit 40. The protective unit 40 is illustrated schematically only in FIG. 5. In the further figures, the protective unit 40 is not shown for reasons of clarity. The protective unit 40 covers an outer side 42 of the netting receiving apparatus 12. The protective unit 40 is provided in order to avoid injuries, such as, for example, clamping of fingers when reaching through the lightweight construction recess 38. The protective unit 40 is provided in order to avoid penetration of soiling, such as, for example, concrete, mud or dirt, into the netting receiving space 34. The protective unit 40 is formed by a fine-meshed net (wire net). Alternatively, at least partial designs of the protective unit 40 by tarpaulins, films, textiles or the like are also conceivable. The netting receiving apparatus 12 has a fastening unit 50 for fastening to the construction machine 10. The fastening unit 50 can also be seen in FIG. 6, which shows a schematic perspective rear view of the netting receiving apparatus 12.

FIG. 7 schematically shows the device 58 with a netting receiving apparatus 12, the closure element 22 of which is equipped with an alternative inhibiting element 20'. The alternative inhibiting element 20' is partially designed as a roll 104. In this case, the device 58 has a plurality of alternative inhibiting elements 20' which are each designed as rolls 104. The alternative inhibiting elements 20' which are designed as rolls 104 are arranged in accordance with a half mesh extent 30 of the netting of the netting unit 14.

FIG. 8 shows a schematic flow diagram of a method for providing nettings in mining and/or tunnel construction by means of the system 56. In at least one method step 106, the device 58 is mounted on the boom 62 of the construction machine 10. In at least one method step 108, the closure elements 22, 32 are moved into the maximum open position. In at least one method step 110, the netting receiving apparatus 12 is moved analogously to an excavator blade in such a way that a netting unit 14 is received in the netting receiving space 34. For this purpose, the netting insertion aid element 46 is moved under the netting unit 14 by a movement of the boom 62 and is subsequently tilted slightly. Alternatively, the netting unit 14 can also be manually inserted into the netting receiving space 34. In at least one further method step 112, the closure elements 22, 32 are closed. In at least one further method step 114, the netting is pulled out of the netting dispensing opening 18. This can be done manually, for example. In this case, the inhibiting elements 20 are elastically bent, with the result that they exert a pressure on the netting. In at least one method step 60, uncontrolled netting output is prevented by exerting the pressure on the netting. In at least one method step 116, the netting is fastened to the rock wall 68 at a first point. This can be done, for example, with the aid of the further boom 64 of the construction machine 10. In at least one further method step 118, the device 58 is moved further along the rock wall 68 by the boom 62. In this case, the netting, which is already fastened to the rock wall 68 at the first point, is pulled further out of the netting receiving apparatus 12. In at least one further method step 120, the further-pulled-out piece of the netting is fastened to a second point of the rock wall 68, for example with the aid of the second boom 64. The two last-mentioned method steps 118, 120 are repeated multiple times until an entire netting web formed by the netting unit 14 is anchored to the rock wall 68. In the favorable case, the netting web of the netting unit 14 extends over an entire length of a tunnel cross section/adit cross section.

The invention claimed is:

1. A device for providing nettings by means of a construction machine, the device comprising:

at least one netting receiving apparatus which is configured to receive and at least partially enclose a netting unit and which has a netting receiving opening and a netting output opening, wherein at least the netting output opening is equipped with at least one inhibiting element which is configured to prevent uncontrolled netting output, wherein the netting receiving apparatus has at least one movably supported closure element for at least partially closing the netting receiving opening.

2. The device according to claim 1, wherein the inhibiting element is of elastic design.

3. The device according to claim 1, wherein the inhibiting element is configured to apply a pressing to at least part of the netting.

4. The device according to claim 3, wherein the inhibiting element is configured to apply the pressing to at least that part of the netting which is currently emerging from the netting output opening.

5. The device according to claim 1, wherein the inhibiting element is arranged on the netting receiving apparatus in such a way that, at least in an unloaded state, the inhibiting element covers at least part of the netting output opening.

6. The device according to claim 1, wherein the inhibiting element is replaceably attached to the netting receiving apparatus.

7. The device according to claim 1, wherein the netting receiving apparatus has at least one guide rail which is configured to guide the closure element on a circumference of the netting receiving apparatus.

8. The device according to 1, wherein, in a closed state, the closure element delimits the netting output opening in sections.

9. The device according to 1, wherein the inhibiting element is configured to apply a pressing to at least part of the netting, and wherein the closure element is configured to adjust the pressing applied by the inhibiting element.

10. The device according to 1, wherein the closure element is designed to be narrower than the netting receiving opening in a main extension direction of the netting receiving opening.

11. The device according to claim 8, wherein the inhibiting element is arranged at a netting output opening-side end of the closure element.

12. The device according to claim 1, wherein the inhibiting element and/or the closure element has a width which corresponds to at least one mesh extent of the netting configured for provision.

13. The device according to 1, wherein the netting receiving apparatus has at least one further closure element.

14. The device according to claim 1, wherein the netting receiving apparatus forms a cylindrical netting receiving space which is configured to receive at least the netting unit.

15. The device according to claim 1, wherein the netting receiving apparatus has a netting receiving space which is overwidth in relation to web widths of netting units which can be provided by the netting receiving apparatus, and which is configured to provide a tolerance range for varying packing widths of otherwise identically designed, netting units.

16. The device according to claim 1, wherein at least one wall of the netting receiving apparatus has lightweight construction recesses.

17. The device according to claim 1, further comprising a protective unit which covers at least part of an outer side of the netting receiving apparatus in order to avoid injuries and/or soiling.

18. The device according to claim 1, wherein the netting receiving apparatus has a support element for positioning the netting receiving apparatus on a base.

19. The device according to claim 1, wherein at least one region of the netting receiving apparatus which delimits the netting receiving opening has a netting insertion aid element which is configured to support an insertion of the netting unit into a netting receiving space of the netting receiving apparatus.

20. The device according to claim 1, wherein the netting receiving apparatus has a bearing unit for rotatably bearing netting roll central rods.

21. The device according to claim 1, wherein the netting receiving apparatus has a fastening unit for fastening to the construction machine.

22. The device according to claim 1, wherein the netting receiving apparatus has stiffening elements which extend parallel to a main extension direction of the netting receiving apparatus.

23. The device according to claim 1, wherein the inhibiting element is designed as a roll.

24. The device according to claim 23, further comprising a plurality of inhibiting elements which are designed as rolls and are arranged in accordance with a mesh extent or a half mesh extent of the netting unit configured for provision.

25. A system comprising:

the device according to claim 1 and at least one netting unit implemented as a netting roll.

26. The system according to claim 25, further comprising a construction machine configured for laying nettings, wherein the device is fixedly connected to the construction machine.

* * * * *